US006231488B1

(12) United States Patent
Dicker et al.

(10) Patent No.: US 6,231,488 B1
(45) Date of Patent: May 15, 2001

(54) AEROBIC EXERCISE GARMENT

(76) Inventors: Timothy P. Dicker, 6906 Foothill Blvd., Tujunga, CA (US) 91042-2780; William T. Wilkinson, 111 Seven Isles, E. 23rd St., Ft. Lauderdale, FL (US) 33303

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,830

(22) Filed: Mar. 12, 1998

Related U.S. Application Data

(63) Continuation-in-part of application No. 08/929,945, filed on Sep. 15, 1997, now Pat. No. 5,875,491.

(51) Int. Cl.[7] ..... A63B 21/02; A41B 1/12

(52) U.S. Cl. ..... 482/124; 482/121; 2/69

(58) Field of Search ..... 482/121, 124, 482/74, 131; 2/69; 450/30

(56) References Cited

U.S. PATENT DOCUMENTS

| | | | | |
|---|---|---|---|---|
| 3,421,514 | * | 1/1969 | Friedlander | 2/54 X |
| 4,230,114 | * | 10/1980 | Feather | 2/69 X |
| 4,866,791 | * | 9/1989 | Carver et al. | 2/106 |
| 5,708,976 | * | 1/1998 | Dicker | 2/69 |
| 5,745,917 | * | 5/1998 | Dicker et al. | 2/69 |
| 5,839,122 | * | 11/1998 | Dicker et al. | 482/124 X |
| 5,857,947 | * | 1/1999 | Dicker et al. | 482/124 |
| 5,875,491 | * | 3/1999 | Wilkinson | 2/69 |

* cited by examiner

*Primary Examiner*—Mickey Yu
*Assistant Examiner*—Denise Pothier
(74) *Attorney, Agent, or Firm*—Connolly Bove Lodge Hutz LLP

(57) ABSTRACT

An aerobic resistance garment is particularly designed for warm weather or indoor or high temperature use by including elastic resistance bands and base fabric material wherein the base fabric material is breathable such as by being made from an open mesh or net material. If desired at least a portion of the midriff may be bare.

10 Claims, 7 Drawing Sheets

AEROBIC EXERCISE GARMENT

CROSS-REFERENCE TO RELATED APPLICATION

This application is a continuation in part of application Ser. No. 08/929,945, filed Sep. 15, 1997, now U.S. Pat. No. 5,875,491.

BACKGROUND OF THE INVENTION

Various garments have been suggested which include elastic elements to provide a resistance to an activity which would require swinging or bending of the arms or legs or the bending of various body parts. Examples of such garments are found in U.S. Pat. Nos. 5,109,546, 5,176,600, 5,186,701, 5,201,074, 5,306,222 and 5,570,472. It would be desirable if such aerobic resistance garments could be made which would be particularly intended for hot weather or indoor use so as to be more comfortable to wear under elevated temperature conditions.

SUMMARY OF THE INVENTION

An object of this invention is to provide aerobic resistance garments which include elastic bands as part of the garment.

A further object of this invention is to provide an exercise garment which is particularly useful for wearing under hot weather or temperature controlled indoor conditions.

In accordance with this invention the garment includes sections which would have different elastic characteristics so as to provide the resistance bands which require a greater resistance force to be overcome by the user while wearing the garment. The other sections of the garment are secured together to form a basic unit and the resistance bands are then incorporated into the unit.

The garment of this invention preferably includes a pants section having a body portion and leg portions and a shirt portion. The base fabric is made of a light weight, breathable material as compared to the resistance bands. Preferably, a mesh material is used for the base fabric and preferably the garment includes a bare midriff.

THE DRAWINGS

DETAILED DESCRIPTION

Figure 1:
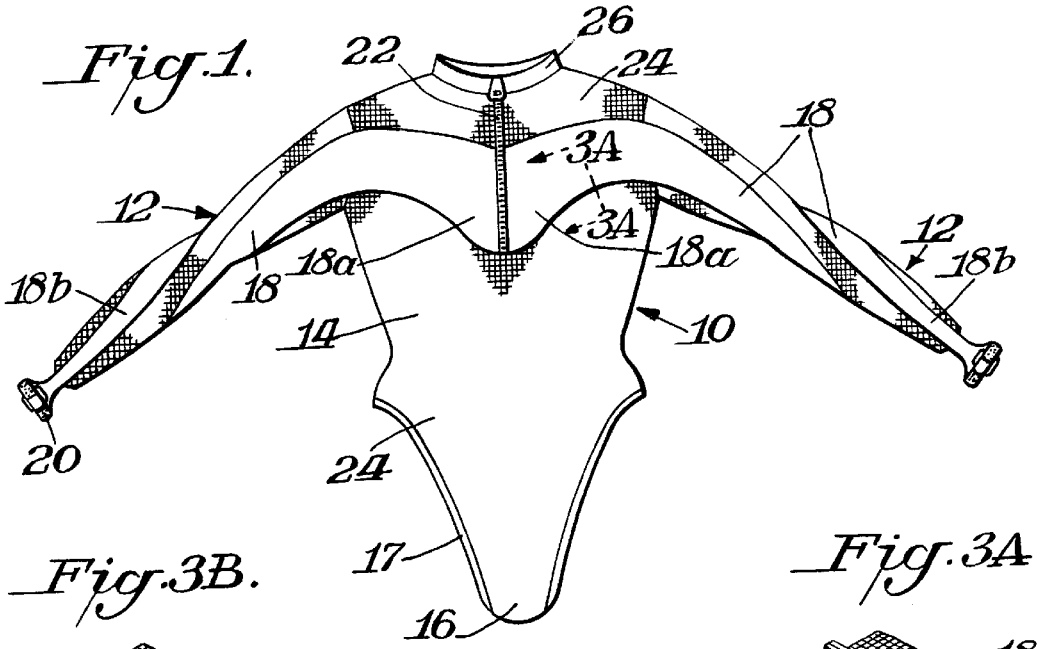
FIG. 1 is a front elevational view of one portion of an aerobic resistance garment made in accordance with this invention.

The present invention relates to manufacturing techniques for incorporating elastic resistance bands into aerobic resistance garments. Reference is made to U.S. Pat. Nos. 5,109,546, 5,176,600, 5,186,701, 5,201,074, 5,306,222 and 5,570,472, and to U.S. patent applications, Ser. No. 627,426 filed Apr. 4, 1996, Ser. No. 660,098, filed Jun. 6, 1996, Ser. No. 734,736, filed Oct. 21, 1996, Ser. No. 761,290, filed Dec. 6, 1996, Ser. No. 777,453, filed Dec. 3, 1996, Ser. No. 802,972, filed Feb. 20, 1997, Ser. No. 802,973, filed Feb. 20, 1997, Ser. No. 834,887, filed Apr. 7, 1997, Ser. No. 840,917, filed Apr. 25, 1997, Ser. No. 880,715, filed Jun. 23, 1997, Ser. No. 892,669, filed Jul. 14, 1997, and Ser. No. 986,521, filed Dec. 8, 1997, all of the details of which are incorporated herein with reference thereto. Such patents and applications exemplify the general types of garments to which the manufacturing techniques may be applied for making garments in accordance with this invention. Other more specific forms will be described in detail hereafter.

In general, the aerobic resistance garment would be made from two different types of materials having different elastic characteristics. It is essential that one of the materials which functions as the elastic resistance elements or bands have a greater resistance force which must be overcome by the user while wearing the garment. The other material could have some degree of elasticity and could be made of the types of materials noted in the aforementioned patents. The base material for the garment would be selected so as to provide comfort to the user. Such material could be a stretch material having four-way or two-way stretch, preferably using a LYCRA spandex yarn. Other examples are DuPont's TACTEL and SUPPLEX. The elastic resistance material would have stretch in at least one direction and would require a greater force by the user to cause the stretch thereby enhancing the aerobic quality of the material. Reference is had to the aforenoted patents for examples of such materials for elastic resistance bands. A suitable material is a raschel knit containing LYCRA spandex.

The garment would include at pre-selected locations the elastic resistance bands. Generally, such bands have anchor structure in order to function as an aerobic garment. For example, where used in the shirt portion of the garment the anchor structure might be at the ends of the arms, such as at the hands or wrists. Where used in the pants portion of the garment the anchor structure might be at the legs or feet and might also be at the shoulders. Other locations of anchor structure might also be used with the practice of this invention. For example, a pants portion may terminate at the waist and anchor structure could be provided at the waist. A pants portion might also terminate in the general area of the knees and the anchor structure could be provided at, above or below the knees. With regard to the shirt portion the elastic band could extend from arm to arm with the anchor structure at each arm. Alternatively, the elastic band could extend from one arm to a further portion of the garment such as on the torso, neck or shoulder area and be provided with anchor structure at that area.

In general, the aerobic garment would be made by first designing the garment and determining the body dimensions. Next, the fabric would be selected and patterns would be made. Preferably the first sample would be cut and sewn and then fitted. After this testing any errors in the patterns would be corrected. A second sample would then be cut, sewn and fitted and corrections made for fit, function and patterns. The patterns would be graded and markers made. Specification sheets would be set up and sewing sheets would be created. Cutting tickets would be written and the final garments would be cut and sewn.

In general, the basic fabric would have its sections sewn together to form a base unit. The elastic aerobic bands would then be incorporated into the basic garment by being sewn at the appropriate locations to form a final garment section. A significant feature of the invention is that the elastic bands are designed so as to minimize the number of pieces required and to avoid seams across the direction of stretch which would otherwise interfere with the performance of the elastic resistance bands. A characteristic of such elastic resistance bands would be the high modulus required to return the bands when stretched. Thus, a physical exertion is required to stretch the bands and the muscles work to hold or restrain the bands when the bands attempt to return to their original unstretched size.

Figure 2:
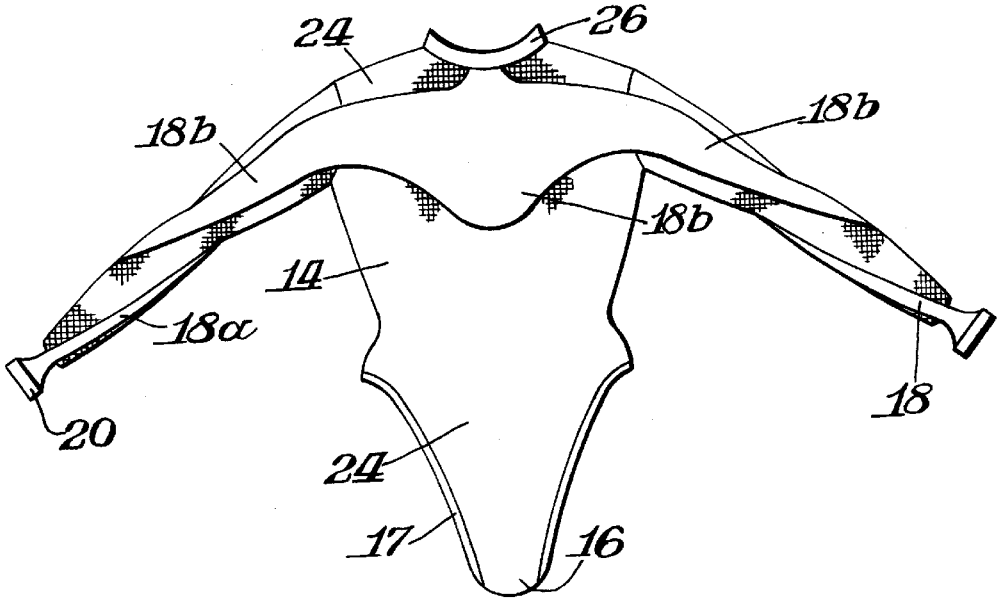
FIG. 2 is a rear elevational view of the garment shown in FIG. 1.

Patent application Ser. No. 802,972 and patent application Ser. No. 802,973, both filed Feb. 20, 1997, disclose manufacturing techniques which could be useful in making garments of this invention. FIGS. 1–8 herein illustrate the various types of garments of those two applications in connection with the manufacturing techniques. FIGS. 1–2 illustrate a shirt portion 10 of a final form of an elastic garment. In the form illustrated therein the shirt portion 10 is a body suit similar to leotards. Thus, shirt portion 10 would include a pair of arms 12,12 a body section 14 and a crotch area 16 with leg openings 17. An elastic resistance band 18 is provided on both the front and rear portions of the garment and with each band 18*a,*18*b* extending from arm to arm and being connected to a loop 20 into which the hand of the user would be on which could be a wrist loop inserted to anchor the elastic band 18. As shown in FIG. 1 the front the band 18 may be interrupted by a zipper 22 which is provided to permit the garment to be easily put on or removed. Where a zipper or other attaching elements are used the full benefits of the elastic band may not be obtained since the location of the zipper is across the direction of stretch of the elastic band. An intent of the invention is to minimize any interference, such as by seams, with the performance of the elastic resistance bands.

Figure 3B:
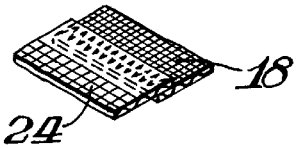
FIGS. 3A and 3B are perspective views showing the elastic band stitched to the base fabric.
Figure 3A:
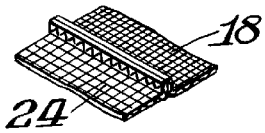

FIG. 3 shows how the elastic resistance band material 18 is stitched to the base fabric 24. The stitching occurs at locations which do not extend across the direction of stretch of the elastic bands. This is a preferred characteristic of the invention to enhance the performance of the garment. As illustrated in FIGS. 1–2 rear band 18*b* rotates around the front of the wrist. Front resistance band 18*a* goes down the arms and terminates underneath the wrists.

Figure 4:
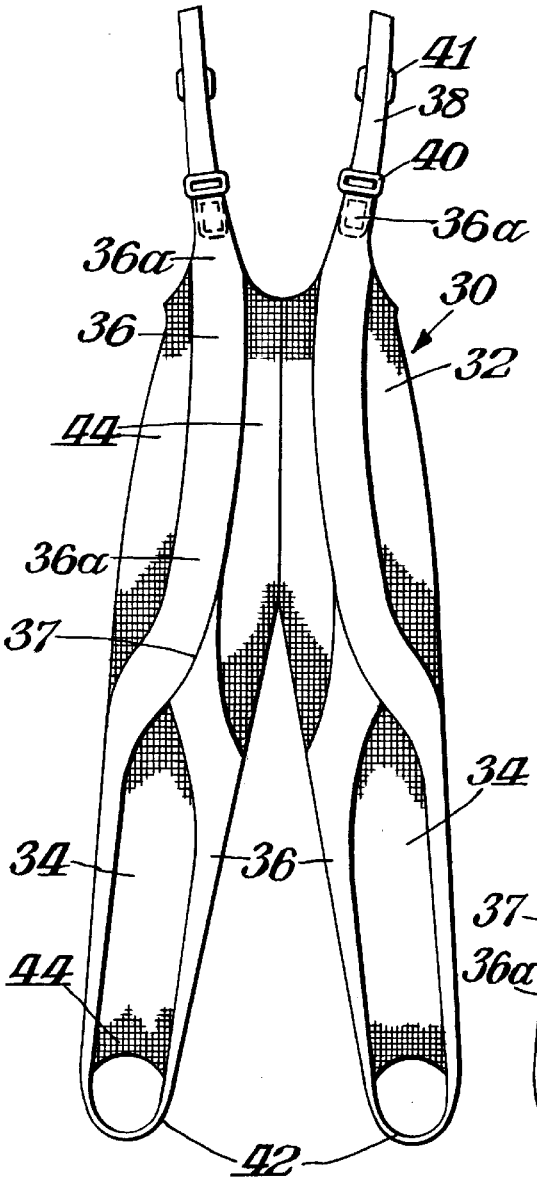
FIG. 4 is a front elevational view of a pants section for an aerobic resistance garment made in accordance with this invention.
Figure 5:
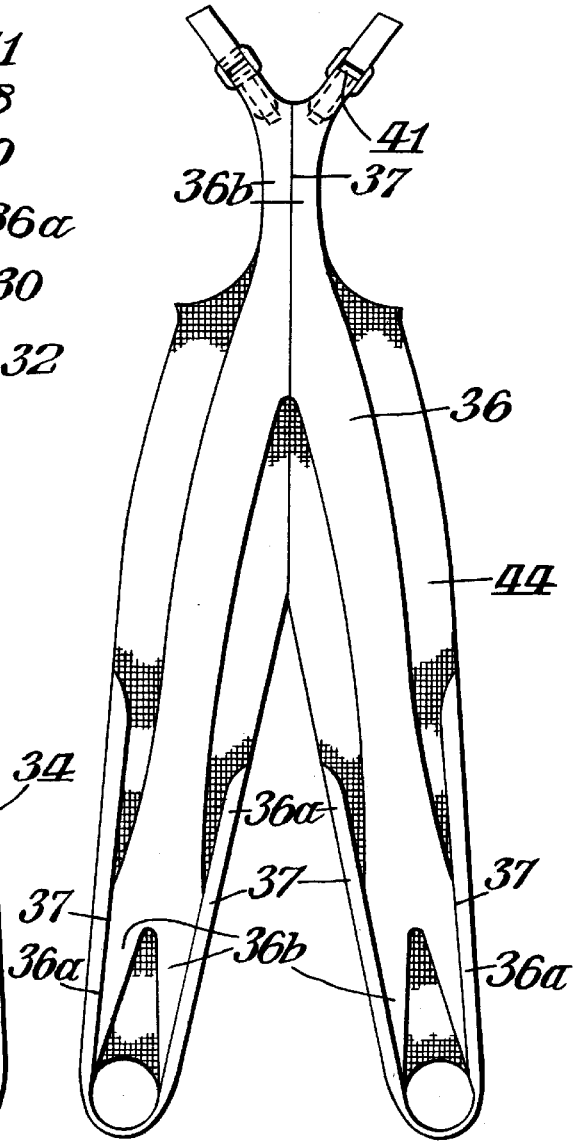
FIG. 5 is a rear elevational view of the pants section shown in FIG. 1.

FIGS. 4–5 illustrate a pants section 30 for the aerobic exercise garment. As shown therein the pants section 30 would have a body portion 32 and leg portions 34. Elastic resistance bands 36 are provided on the leg portions and extend upwardly from the body portion 32 to form suspenders 38. The base fabric is indicated by the reference numeral 44. As later described buckles or other adjusting devices 40 would also be provided to permit the proper fit to be attained by the user. As illustrated in FIGS. 4–5 the elastic resistance bands 36 also form loops or stirrups 42 which would function as anchor elements at one end of the pants with the suspenders being placed over the shoulders functioning as anchor elements at the other end of the pants.

Figure 6:
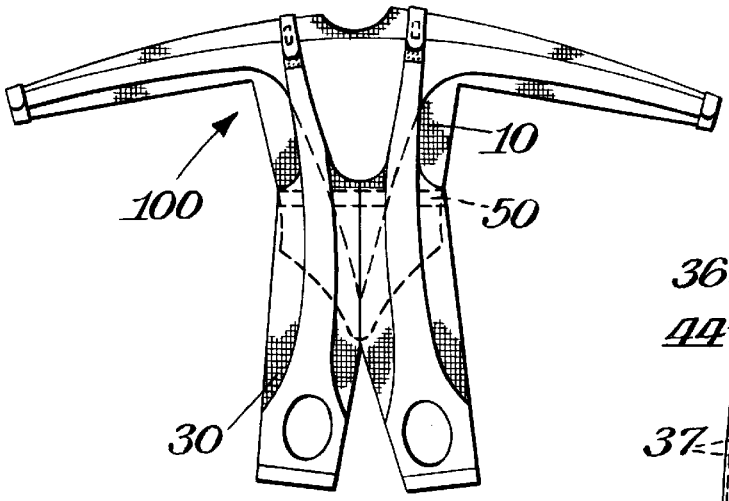
FIG. 6 is a front elevational view showing both garments of FIGS. 1–2 and FIGS. 4–5 assembled into a combined product.

If desired each of the shirt portion 10 and the pants portion 30 may be worn separately to function as an individual aerobic exercise garment. Alternatively, as shown in FIG. 6 the shirt portion 10 and pants portion 30 may be worn together to form a combined exercise garment 100. When worn together the shirt portion 10 and pants 30 may be secured together by any suitable attaching structure 50 such as detachable elements including, but not limited to, clips, buttons, VELCRO® or maybe permanently attached by stitching or other suitable means.

As shown in FIG. 1 the elastic resistance bands 18 on the front of the shirt 10 includes two separate elastic bands 18*a,*18*a* which extend from the central portion of the body 14 completely to and beyond the ends of the arms 12. The two elastic bands 18*a,*18*a* are secured together by zipper 22. As shown in FIG. 2 the elastic resistance band on the back of the shirt is a single elastic band 18*b* which extends from arm to arm completely across the body portion 14 of the shirt. Each elastic strip or band 18*a,*18*b* is connected to a band of cushioning material such as neoprene which forms a closed loop by any suitable detachable fasteners such as buckles, clips or VELCRO® so as to provide anchor structure for the elastic bands. If desired the loop 20 could be a permanently closed loop made of elastic material to function as a compression band which would accommodate various sizes of users.

As shown in FIG. 4 pants 30 includes on its front side a first set of elastic bands 36*a,*36*a* which extend from the suspenders and down the pants to a location slightly above the knee. The elastic resistance band 36*a* then shifts its direction toward the outside and continues down the leg forming the loop 42 and then continues up the leg where it terminates and is secured to itself by the seam 37. As can be appreciated the seam 37 is at a location which is not across and thus does not interfere with the direction of stretch of the elastic resistance band 36*a*. As should also be appreciated this arrangement permits the use of a single piece of elastic resistance band fabric to be used on the front side of pants 30 for each leg 34.

FIG. 4 illustrates the back side of the pants 30. As shown therein a second pair of elastic bands 36*b,*36*b* is provided which extends from the suspenders and runs the length of the body portion to a location below the knee where each band bifurcates and then is joined to a corresponding portion of the front band 36*a*.

The bifurcated portions of elastic band 36*b* are sewn to front band 36*a* by stitching 37. The individual elastic bands 36*b,*36*b* are sewn together in the suspenders portion of the pants by stitching 37. Thus, all of the stitching of the elastic band is at a location which does not interfere with the direction of resistance of the elastic bands.

The extended portions of bands 36*a* and 36*b* are connected together to form the suspenders 38. If desired, each band 36*b,*36*b* may be permanently sewn or connected to a loop member 41 as shown in FIG. 5, by extending around the member 41 and being sewn to itself. The opposite bands 36*a,*36*a* may extend through a double slotted buckle 40 and then through the loop member 41. The end of each band 36*a,*36*a* may then be sewn to itself thereby providing a loop structure between buckle 40 and loop member 41. This provides adjustability in the effective length of the suspenders 38. Padding may be provided on the underside of the portion of bands 36*a,*36*a* which comprise their part of the suspenders 38.

In making the shirt portion 10 the front and back crotches are sewn together with the crotch liner extending wrong side up on the back. Next, the side seams of the body are sewn together to form a basic unit. The crotch liner is flipped over to the front. Elastic is stitched to the legs, turned and cover stitched and the underarms are sewn to the body portion. The upper arms are sewn to the shoulders. The front elastic bands 18*a* are sewn to the shoulders/upper arms and the back elastic band 18*b* is also sewn to the shoulders/upper arms.

In making the shirt portion 10 the process continues with the running of a binding or sewing of a collar 26 to the neck. The collar could also include appropriate labels. Zipper 22 is sewn to the center front joining the patterns for the fabric 24 and the elastic band 18. The zipper is top stitched. The front and back bands 18 are then sewn to the body and lower arms. Seam allowance is turned at the sides of the hands (i.e. the bottom of the arm) and cover stitched. The inner edge of the hands are stitched together. Next, neoprene bands or strips are cover stitched which would form the loops 20. VELCRO® hook fabric is sewn to the top of the neoprene bands with the neoprene bands sewn at the bottom edges of the hands or ends of the sleeves and with the VELCRO® hook located at the outer edge of the hands on the neoprene (or other suitable material) bands, so that the loop 20 could be adjustably formed in accordance with the proper circumferential dimension of the proper user.

FIGS. 4–5 are now referred to with regard to the making of the pants section 30. The center back legs fabric 44 and back bands fabric 36 would be sewn together. Next, the back bands 36*b* would be sewn together from above the crotch to the center back. The left and right sides would be sewn to the back bands 36*b*. The center front rises are sewn together and the upper front legs are sewn to the upper back legs. Then, the top of the back ankle inserts are sewn between notches to the bottom of the back bands 36*b*. The inner edge of the front ankle inserts are sewn to the short edge of the short curved section of the front bands 36*a*. The upper edge of the short curved section of the front band 36*a* is sewn to the front inner thigh, inner edge of back band 36*b* and back ankle insert. Then the inner edge of the front bands is sewn from the waist to the foot picking up the other end of the bands 36*a* and outer edge of the front ankle inserts. The outer edge of the bands 36*a* is sewn to side panels picking up the lower edges of the back bands and outer edge of the back ankle inserts. Then, the openings of stirrup 42 are cover stitched. A ⅜ inch elastic strip is sewn to the outer edge of the back band 36*b* along the sides to the front notch above the waist then a ⅜ inch rubber elastic strip is sewn to the center back edges (inner edges of Y) at the top of the back bands 36*b*. The ⅜ inch elastic is turned and cover stitched with labels at the center of the back. The strap portions of bands 36*a* above the ⅜ inch elastic are turned and sewn on top of a 1½ inch elastic strip. A folder could be used if desired. The ends of the back and front straps 38 are over locked. Next, bar tack the intersection of the Y and the labels. Loops 41 are sewn at the ends of the back Y. Finally, loops 41 are sewn on the front bands.

It is to be understood that the manufacturing techniques described above may also be adapted for making aerobic exercise suits of different configurations than those specifically illustrated herein.

Tests were conducted on the two piece suit 100 to compare the metabolic changes that occur during treadmill walking while wearing the suit in comparison to standard exercise apparel. The following are the test results:

Subject Selection

A well-conditioned 56-year-old professional male subject (maximum oxygen consumption=47 ml $kg^{-1}$ $min^{-1}$, height=69", weight=168 lbs) with over 160 treadmill test experiences served as the subject for this investigation. To accurately test the garment 100, it was necessary to have a subject who knew how to precisely duplicate the arm and leg mechanics for both the control conditions (NPGS=No Power Garment Suit 100) and the experimental Power Garment Suit 100 conditions (PGS) during each submaximal treadmill test. It was critical to have a reliable test conducted each time to reduce test-to-test variability under the control as well as the experimental suit 100 conditions.

Test Protocol and Parameters Monitored

A modified McHentry treadmill protocol was used. In this study the speed remained constant at 3.6 mph, and three Stages for 9 minutes at a 0% grade, then 3 minutes at 3% and then 3 minutes at 6% grade were used. The typical surfaces upon which people walk range between 0% to 6%.

A single-lead telemetry ECG was used to monitor exercise heart rates, and a MedGraphics 2000 gas analysis system was used to measure the metabolic oxygen cost of the exercise throughout each test. The sustained 9-min workload at 3.5 mph/0% grade was used to reflect the recommended speed used during fitness walking programs. The two additional percent grades are commonly encountered by fitness walkers within the confines of their local neighborhoods.

Oxygen consumption represents the amount of oxygen in milliliters per kilogram (2.2 lbs) of body weight (ml $kg^{-1}$ $min^{-1}$) required by the human body to conduct its metabolic activity during various levels of muscular effort. Energy producing organelles (mitochondria) in skeletal muscle tissue increase their oxygen requirements to reduce sugar and fat to a usable energy source called ATP (adenosinetriphosphate) as the muscles are increasingly stressed. By assessing the oxygen requirements of the body at any given moment, it is possible to evaluate the effects of the suit 100 on the muscular efforts of the body, and more importantly, the metabolic cost of exercising in the suit 100.

Results of the Investigation

In this investigation, the suit 100 used during treadmill walking at 3.5 mph/0.% grade produced a 33.37% greater metabolic response than did the standard exercise apparel (control garments) which included a cotton T-shirt, sneakers, socks and tennis shorts. The average oxygen consumption value of 21.74 ml $kg^{-1}$ $min^{-1}$ during the suit 100 use at 3.5 mph/0% grade in this investigation was greater than the values reported in the following published studies in which subjects carried varying sizes of hand-held weights (HHWs).

Zarandona et al (*Physician and Sports Medicine,* 14(10): 113–120, October 1986) tested 30 trained men who carried either no HHWs, 1-lb weights, or 5-lb weights in both hands while treadmill walking at 3.5 mph/0% grade. They reported statistically significant values of 15.05 and 19.00 ml $kg^{-1}$ $min^{-1}$ while using 1-lb and 5-lb HHWs respectively. Other authors have also reported statistically significant increase in metabolic cost when their subjects were using 1-lb and 3-lb HHWs. See *Medicine and Science in Sports and Exercise,* 19(3): 260–265, June 1987 and *Research Quarterly,* 63(4): 435–437, December 1992.

Table 1 reports the oxygen consumption cost of walking at 3.5 mph/0% grade while wearing the suit 100.

TABLE 1

| $VO^2$ ml $kg^{-1}$ $min^{-1}$ difference and % increase for NPGS* and PGS** conditions during 3.5 mph/0% grade treadmill walking | | | |
|---|---|---|---|
| NPGS | PGS | Difference | % increase |
| 16.30 | 21.74 | 5.44 | 33.37 |

*NPGS = no power garment suit
**PGS = power garment suit 100

Conclusions

1. The suit 100 produced a 33.37% greater increase in the metabolic cost of walking at 3.5 mph/0% grade than standard aerobic exercise apparel (cotton T-shirt, socks, sneakers, and tennis shorts).

2. In comparison to published hand-held weight studies, walking at 3.5 mph/0% grade while wearing the suit 100 produces a metabolic cost in oxygen consumed per minute that is 14.42% greater than when carrying two 5-lb hand-held weights while walking at the same speed and grade.

3. The built-in resistance bands of the suit 100 eliminate the need for carrying hand-held weights that involve isometric gripping which is known to cause elevated blood pressures.

Figure 7:
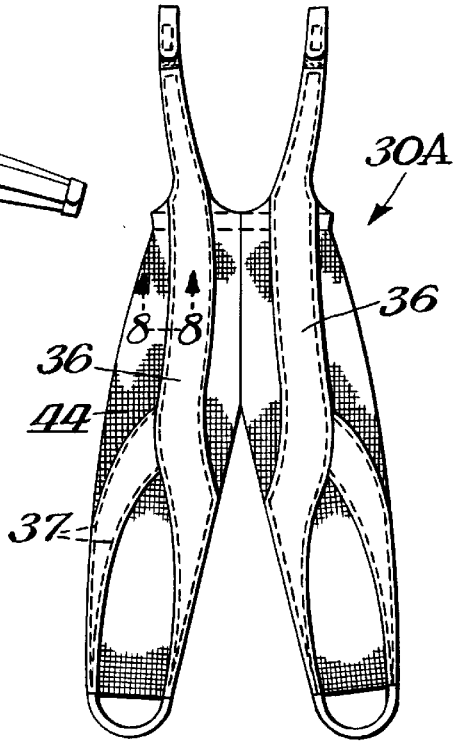
FIG. 7 is a front elevational view of a modified aerobic exercise garment in accordance with this invention.
Figure 8:
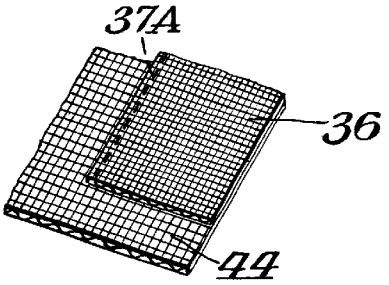
FIG. 8 is a cross-sectional view taken through FIG. 7 along the line 8—8.

The invention has been particularly described with respect to FIGS. 1–6 wherein the elastic resistance bands form panels which separate and are joined to base fabric material. The invention may also be practiced where the base fabric material in itself is a complete garment such as a shirt, pants, etc. and the elastic resistance bands are sewn on top of or below the base fabric. FIGS. 7–8, for example, illustrate a pants 30A of generally the same structure as pants 30 except that the elastic bands 36 are formed directly over the base fabric. This is shown, for example, in FIG. 8 where the elastic band material 36 is superimposed over (or below if desired) the fabric 44 and secured thereto by stitching 37A.

It is also to be understood that the invention may be practiced with forms of garments other than specifically described herein. For example, the pants may be short pants, particularly adapted for warm weather or indoor use and the base fabric may be made of a mesh material. A further variation would be to form the pants portion as a wrestler's suit which in turn incorporates the elastic bands in the manner herein described.

Reference is also made to application Ser. No. 777,455, filed Dec. 30, 1996 which is specifically directed to an aerobic resistance garment for indoor use or warm weather use. The present invention may be practiced by incorporating various aspects of the garments described in that application.

The present invention is particularly intended to address the need for an aerobic resistance garment that can be worn year round indoors or outdoors by being designed to be cooler when worn while exercising in warmer temperatures. Such a garment is preferably worn in hotter summer months or indoors where the temperatures are not cool. In general, such a garment can be of one piece or more than one piece construction. Where it is of one piece construction the garment can be a top, such as a shirt or halter or can be a bottom such as pants or shorts. The top and bottom can be permanently joined together or detachably joined together or not connected at all. The materials in accordance with this invention are made from a basic fabric which is breathable or cool such as cotton, Coolmax or various types of porous mesh/net fabric or a lightweight solid fabric. Preferably, in order to be breathable the garment includes open areas wherein the amount of open area is, for example, at least 10% of a given garment area. Preferably, a larger amount of open area would be used, such as 20% and more preferably at least 50% or 60% or 75% of the base material being of open area. The elastic bands, however, need not be of such breathable, cool, lightweight material and preferably do not have as much open area as the base fabric.

The top could have sleeves of any length, but preferably the sleeves would be shorter extending only to or just above or just below the elbow. Alternatively, the shirt could be sleeveless. The pants could be of any length, but preferably are shorts which extend to just above or just below the knee. Alternatively, the pants could be legless, such as a leotard. The resistance bands could be incorporated in the top and/or in the shirt and/or in the pants but preferably are included in the shirt or top. The midsection could be covered, but preferably at least a portion of the midsection or midriff is bare. The shirt and pants could be joined anywhere at one or more locations, such as at the back, front, sides, etc.

Where the garment is of multi-piece construction the individual pieces can be of any suitable number, but are preferably of two pieces, namely a top/shirt and pants/shorts. Alternatively, either the top or pants could individually be made of multi-pieces. The pieces could be attached or joined to form a single unit by any suitable fasteners such as snaps, buttons, buckles, VELCRO, zippers, hooks, etc.

The top and/or bottom can be of loose or can be of tight fit. The top is preferably a halter/tank top or a tee shirt with resistance bands in the front back and/or sleeves. The sleeves can also be generally elastic/resistant and thus the entire sleeves comprise the resistance bands. The top can be sleeveless with only spaced resistance bands or a single band joined, for example, to a cuff, loop, ring, glove, etc. as it's anchoring element. Similarly, the pants/shorts can be generally elastic/resistant and have no resistance band per se since the legs of the pants would function as a resistance band. Also, the pants/shorts could be legless with one or more spaced bands extending down the leg anchored by a cuff loop ring or stirrup.

Figure 9:
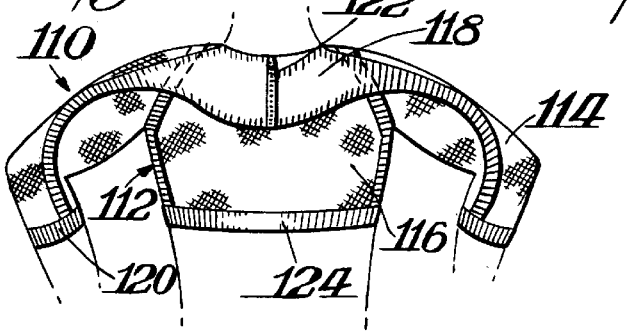
FIGS. 9–12 are front elevational views of garments made in accordance with this invention.

FIG. 9 illustrates the shirt portion 110 of a garment in accordance with this invention. As shown therein, the shirt portion 110 includes a body portion 112 and arms or sleeves 114. The garment is made of a base material 116 which is lightweight and cool such as being made from a mesh/net material which is highly breathable. An elastic band 118 extends across the front of the body and down the arms. A similar band could be provided along the back. Each band is anchored by a forearm cuff 120. A zipper 122 or other suitable means may be provided to facilitate placing the garment on the body and removing the garment from the body.

Although FIG. 9 illustrates the sleeves to extend to just below the elbows, the sleeves could terminate in the arm pit area or could extend to the wrists. A compression band 124 is located along the bottom of the shirt 110. When worn with pants the pants would be spaced from compression band 124 thus leaving a bare midriff.

Figure 10:
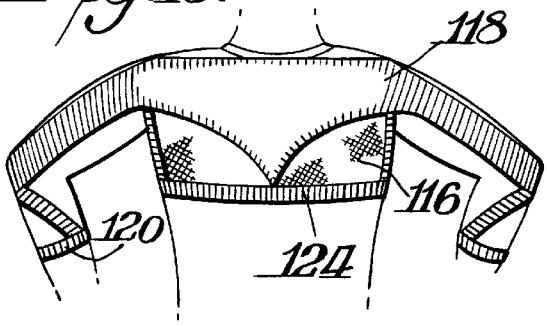

FIG. 10 illustrates a variation of the garment shown in FIG. 9. One of the differences is that the base fabric does not extend down the sleeve. Instead the band 118 alone extends down the sleeve to be anchored at the cuff 120. As noted, a similar band may be provided on back of the garment. Thus, the arms of the user are bare except for the resistance bands.

Figure 11:
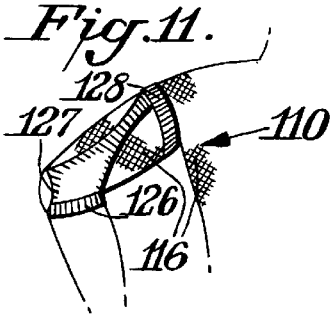

FIG. 11 shows a variation wherein the shirt 110 includes an elastic band 126 which is located only in the sleeve area. Band 126 extends from a shoulder compression loop 128 and terminates just below the elbow. The base fabric 116 could be included along the sleeve as well as the body portion of the shirt for garment 110. FIG. 11 also illustrates the possibility of including a cutout 127 in the elbow area thus leaving a bare elbow.

Figure 12:
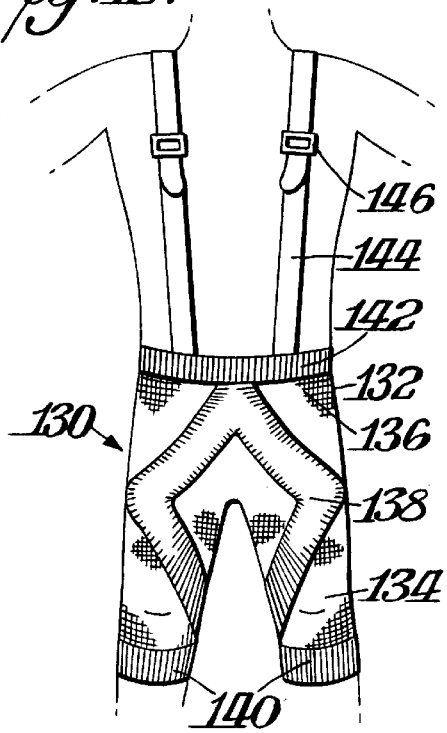

FIG. 12 illustrates a pants or bottom 130 which is formed in accordance with this invention. As shown therein, the pants 130 has a body portion 132 and leg portions 134. Base fabric 136 is used in combination with elastic band 138. The elastic band could be anchored by a compression cuff 140 below the knee and a waist compression band 142. Suspenders 144 could be provided having buckles 146 or other adjustable fasteners to not only facilitate the wearing of the pants 130 but also to provide for greater or lesser resistance in accordance with the tightness of the suspenders. Although FIG. 12 illustrates the legs as terminating just below the knees, the legs could terminate just above the knees or in the crotch area or could extend to the ankles. Pants 130 could be worn with shirt 110 or with any other type of shirt which may or need not include resistance bands.

Figure 13:
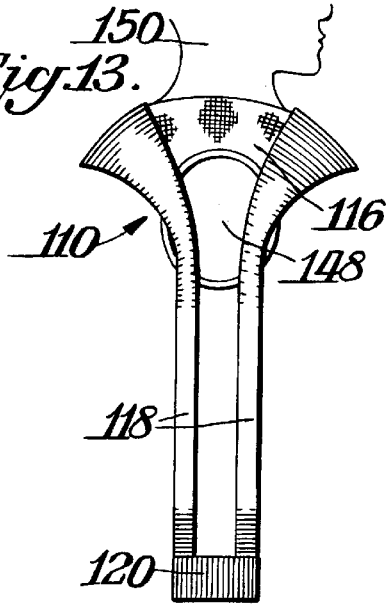
FIG. 13 is a top plan view of a portion of a garment in accordance with this invention.

FIG. 13 illustrates a side elevational view of a portion of a shirt 110 which incorporates only resistance bands 118 along the sleeves with the garment otherwise being sleeveless and thus the user's arms are bare in areas where there is no resistance band. As illustrated and indicated by the reference numeral 148 the shoulder area of the garment is open since there is no sleeve. The user's head 150 is also shown.

Figure 14:
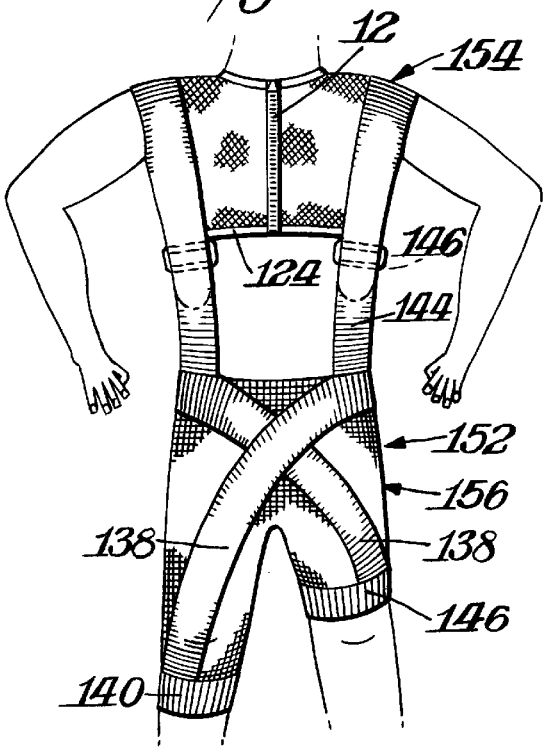
FIGS. 14–23 are elevational views of garments or portions of garments in accordance with this invention.

FIG. 14 illustrates a garment 152 which includes a shirt or top portion 154 made of base fabric with a zipper 122 provided. Top 154 could be worn with pants 156. Top 154 could take the form of any of the previously described shirts being of halter form which terminates in a band 124 thus leaving a bare midriff between the lower portion of shirt 154 and the upper portion of pants 156. Pants 156 could include suspenders 144 and buckles 146. FIG. 14 illustrates various options for the length of the legs for pants 156 such as terminating just below the knee at resistance cuffs 140 or just above the knee at resistance cuffs 156. The resistance bands 138 would extend from the top or waist portion of pants 156 and terminate at the bottom to be anchored by its respective cuff.

Figure 15:
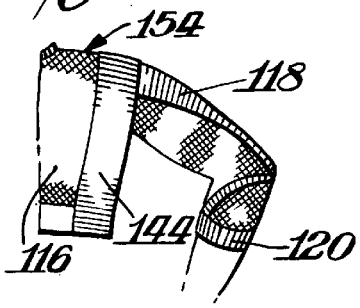

Although FIG. 14 shows the shirt 154 to be sleeveless without any resistance bands, FIG. 15 illustrates a shirt 154 which includes the base fabric 116 and includes resistance band 118 extending down the sleeve in a manner previously described.

Figure 16:
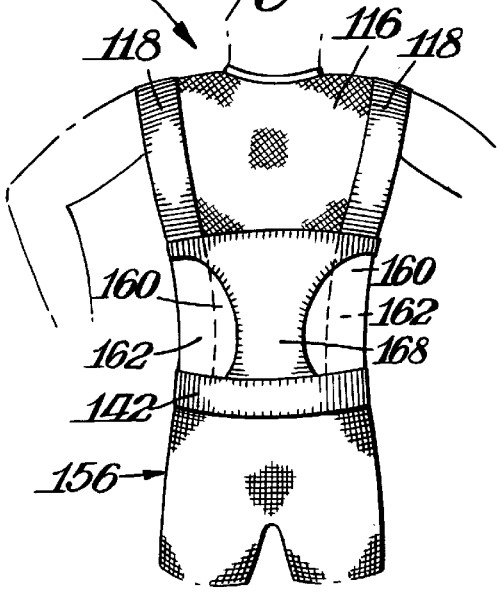

FIG. 16 shows a variation wherein the shirt 154 is a halter top having base fabric 116 and resistance bands 118 with a center band 142 extending from the bottom of the halter top or shirt 154 and connected to the waistband 142 of pants 156. The center band is preferably made of stretchable material similar to the resistance bands 118,138 and thus functions as a resistance band. Portions 160 of the midriff are bare to facilitate breathability of the garment. FIG. 16 shows in phantom the option of providing side resistance bands 162 which could also span the bottom of the shirt 154 and top of the pants 156 but still leave substantial portions of the midriff bare. The various connecting members such as center bands 158 and side bands 162 could be permanently or detachably secured to pants 156. If desired, the connecting piece 158 and/or either of the side bands 162 could be made of an open base fabric material.

Figure 17:
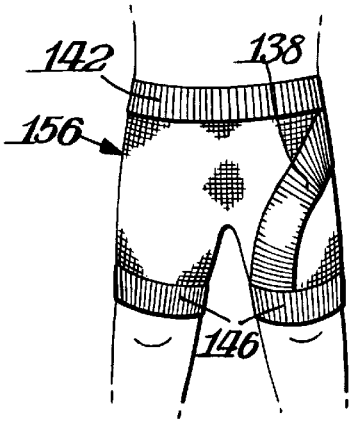

FIG. 17 shows yet another form of pants 156 which extend from the waistband 142 to just above the knees at bands 146 to form shorts. The shorts may have one or more resistance bands 138 or may include no resistance bands particularly when worn with a shirt having resistance bands.

Figure 18:
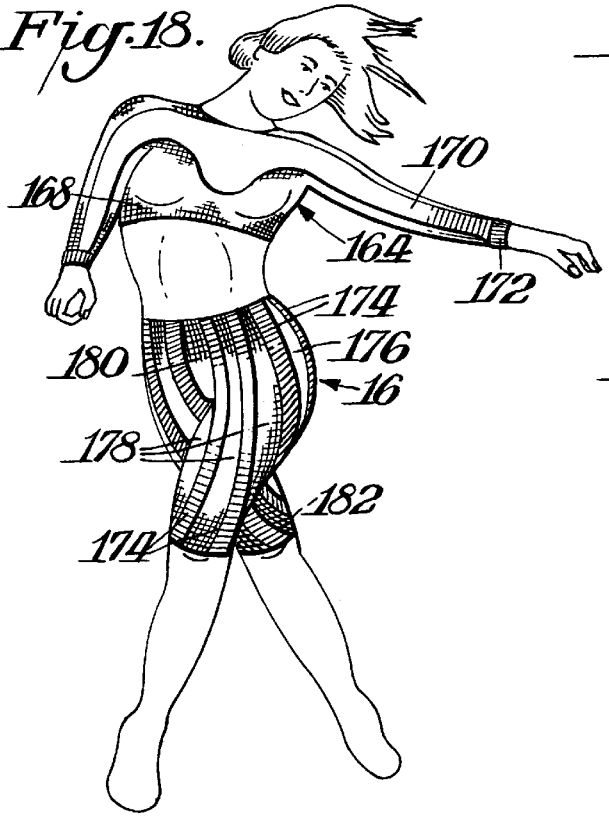

FIG. 18 shows yet another garment in accordance with this invention. As shown therein the garment includes a halter top 164 and shorts 166. The base fabric 168 for the top 164 could be made of four-way 18–20% nylon base fabric. The elastic bands 170 could be made of a 30% nylon material. Bands 170 could be anchored by neoprene/coolflex/nylon wrist compression cuffs 172.

As illustrated in FIG. 18 the shorts 166 includes a plurality of elastic bands 174 separated by base fabric. The various resistance bands 174 could be made of, for example, 30% nylon material. Each of the sections of base fabric, however, could be made of different base fabric materials in accordance with their location. For example, strips of base fabric 176 could be made of two way 27% nylon to function as a thigh flattener. Other base fabric strips 178 could be made of 18–20% four-way nylon. Strip 180 could be made of two way 27% nylon to function as an abdominal flattener. Thus, the base fabric strips 176,180 at the thighs and abdomen have greater resistance characteristics than intermediate strips 178. The end of each leg could terminate in a neoprene/Coolflex/nylon compression ring 182 which is shown in phantom. If desired, a waistband may also be provided.

The embodiment of FIG. 18 could be practiced by having the elastic bands vary in percent of nylon from a high percentage located at the back of the garment to a lower percentage in the front. This would fine tune the resistance value of the garment by having greater resistance for the resistance band at the back of the garment.

With the garment of FIG. 18 the mid section or midriff between the halter and shorts could be bare. Alternatively, the halter and shorts could be joined by connecting pieces which could be of base fabric material or of elastic resistance material similar to FIG. 16.

Figure 19:
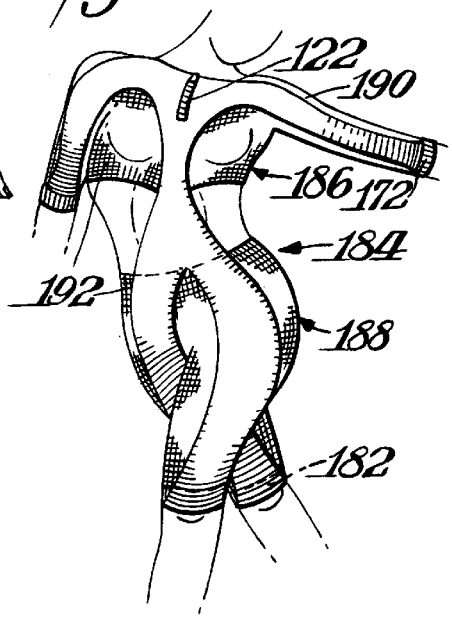

FIG. 19 shows a variation wherein the garment 184 is of one piece construction having a halter top 186 joined to shorts 188. The garment 184 includes an elastic band 190 which extends from the halter to the shorts and is flanged to have mid/forearm resistance. If desired, compression cuffs 172 and 182 may be provided on the arms and legs in the forearm area and at the knees respectively. Such compression cuffs could be made of neoprene/coolflex or any other material with memory to function as a compression ring. The elastic band 190 could be made of 30% nylon material and could be, for example, 4–6 inches wide. The base fabric 192 in the halter/top and shorts could be, for example, 20% nylon. The midriff area could be bare on each side of band 190. As illustrated a zipper 122 could also be provided to facilitate removal and placing the garment on the user.

Figure 20:
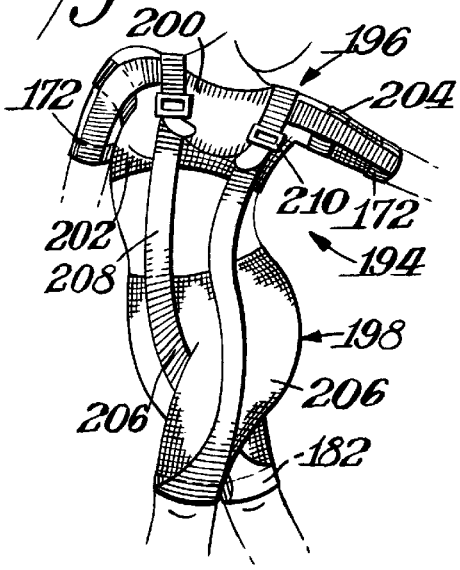

FIG. 20 illustrates a two piece garment 194 having a halter top 196 and shorts or pants 198. The top 196 could include an elastic band 200 made of 30% nylon material and base fabric material 202 made of 18–20% nylon. The band 200 could extend down the arms such as to the elbows and be anchored not only by compression cuffs 172 but also by one or more intermediate compression cuffs 204. The shorts could include resistance bands 206 which would extend to the compression cuffs 182. If desired, resistance bands 206 could extend above the shorts and function as suspenders 208 having adjustable length by means of buckle 210 or other suitable fasteners. Bands 206 are preferably 30% nylon 4 inches wide. The multi-compression cuffs 172,204 may be made of 30% nylon. The base fabric in the thigh area of the shorts could be made of 20% nylon material.

It is to be understood that while various previously described and later described figures illustrate resistance bands on the front of the garment, the back of the garment would preferably also include resistance bands which could be identical to or vary from the front resistance bands.

Figure 21:
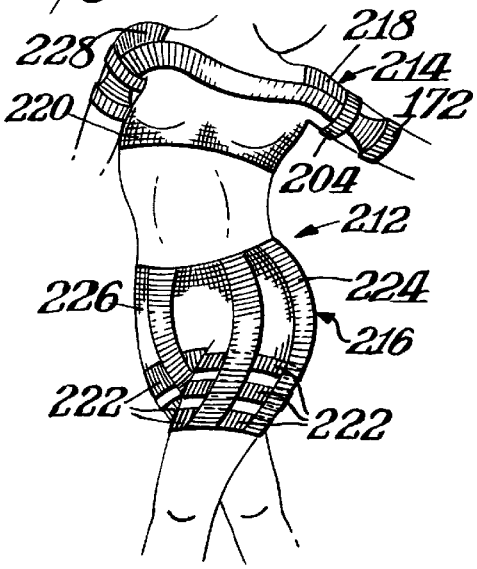

FIG. 21 illustrates yet another form of garment 212 to be used as an undergarment and which includes a separate halter top 214 and shorts 216. A resistance band 218 may extend across the front of top 214 above the remainder of the halter which could be in the form of a sports bra 220 made from base fabric such as an open mesh made from any suitable material such as nylon or coolmax. A plurality of anchorings such as cuffs 172,204 may be provided on the arms with a plurality of anchorings 222 provided on the legs. As previously described the anchoring could be compression cuffs. The main resistance band 224 in the shorts could be made of double strength nylon with a breathable base fabric 226 made of material such as cotton, nylon mesh, etc. Another distinctive feature of garment 212 is the inclusion of a resistance band 228 in the deltoid region of the arm to offer resistance and an anchor point during arm raising motions.

Figure 22:
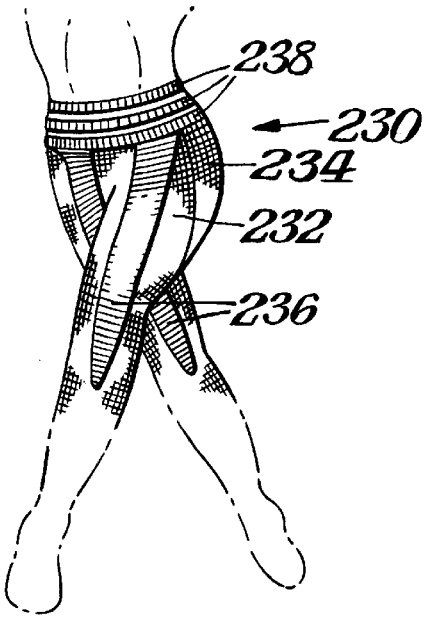

FIG. 22 illustrates a garment 230 which would be of pantyhose type construction of full length. As shown therein, the base material 232 could be of conventional pantyhose material such as nylon and would include resistance bands 234 located at the thigh and which could be made of double nylon material with mid-thigh resistance bands 236 also made of double nylon material. The posterior would have the same arrangement of resistance bands. A characteristic of the garment 230 is that the resistance bands fade into the base material as their lower end rather than having anchoring cuffs. Such feature may be used with other garments. At the upper end of garment 230, however, there is a plurality of abdominal tension rings 238 made, for example, of double nylon.

Figure 23:
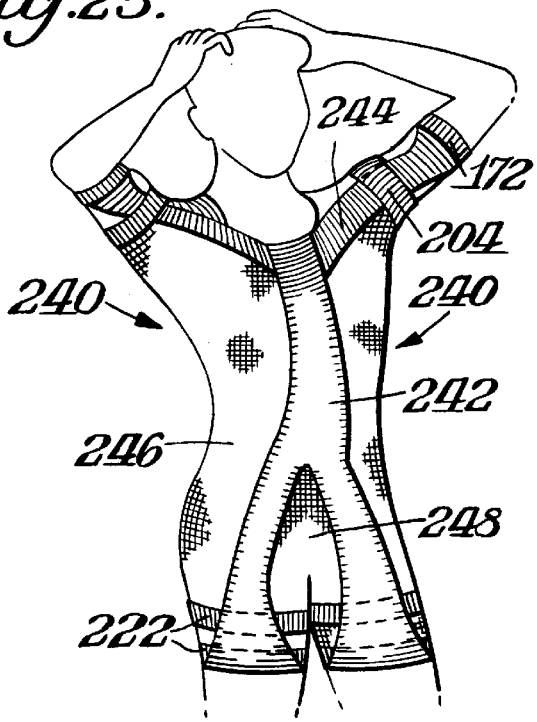

FIG. 23 illustrates a one piece garment 240 having a central resistance band 242 which extends for providing abdominal, thoracic and leg resistance. Further resistance bands 244 extend outwardly from central bifurcated band 242 along the upper arms. A pair of anchor rings 172,204 may be provided for bands 244 while a plurality of anchor bands 222 is provided for the lower end of resistance band 242. The remainder of garment 240 would be made of any of the previously noted base fabric 246 with an abdominal panel 248 provided made of a nylon material. If desired, portions of the base fabric 246 could have cut out to provide bare midriff sections.

It is to be understood that the various embodiments described and illustrated herein may include features which could be used in other embodiments within the practice of this invention. Thus, for example, various specific base fabrics described for a particular embodiment may be used with other embodiments.

What is claimed is:

1. An aerobic resistance garment for use in warm weather or high temperature conditions comprising a shirt portion having a body portion and arms, said shirt portion being in the form of a sports bra made of open mesh/net base fabric material, a pants portion in the form of shorts made of a base fabric with a trunk portion and legs, each of said shirt portion and said pants portion including at least one elastic resistance band requiring a greater force to stretch said band and resist said band from returning to its unstretched condition than the force required for said base fabric in said shirt portion and said pants portion, said sports bra portion being spaced from said trunk portion to provide a bare midriff when in use, wherein said shirt portion includes sleeves, said elastic resistance bands extending across said body portion and down said sleeves, and each of said sleeves having a compression anchoring cuff, and an end of said band being secured to said anchoring cuff.

2. An aerobic resistance garment for use in warm weather or high temperature conditions comprising a shirt portion having a body portion and arms, said shirt portion being in the form of a sports bra made of open mesh/net base fabric material, a pants portion in the form of shorts made of a base fabric with a trunk portion and legs, each of said shirt portion and said pants portion including at least one elastic resistance band requiring a greater force to stretch said band and resist said band from returning to its unstretched condition than the force required for said base fabric in said shirt portion and said pants portion, said sports bra portion being spaced from said trunk portion to provide a bare midriff when in use, said at least one elastic resistance band extends across said body portion of said shirt portion and down said arms, a plurality of compression cuffs on each of said sleeves and said elastic resistance bands being secured to said compression cuffs.

3. An aerobic resistance garment for use in warm weather or high temperature conditions comprising a shirt portion having a body portion and arms, said shirt portion being in the form of a sports bra made of open mesh/net base fabric material, a pants portion in the form of shorts made of a base fabric with a trunk portion and legs, each of said shirt portion and said pants portion including at least one elastic resistance band requiring a greater force to stretch said band and resist said band from returning to its unstretched condition than the force required for said base fabric in said shirt portion and said pants portion, and said sports bra portion being spaced from said trunk portion to provide a bare midriff when in use, said base fabric of said shirt portion and of said pants portion being made of an open mesh/net material having at least 20% open material, and there being more open area in said base fabric than in said elastic bands.

4. The garment of claim 1 wherein said base fabric material is of at least 50% open material.

5. The garment of claim 3 wherein said elastic bands extend longitudinally down said legs and are connected to and anchored by at least one compression cuff.

6. The garment of claim 5 wherein each of said longitudinally extending elastic bands of said pants portion is connected to a plurality of spaced parallel compression cuffs.

7. The garment of claim 3 wherein said elastic resistance bands are on the front of said garment and on the back of said garment, and said elastic resistance bands on said back of said garment having greater resistance characteristics than said elastic resistance bands on said front of said garment.

8. The garment of claim 3 wherein each of said longitudinally extending elastic bands of said pants portion is connected to a plurality of spaced parallel compression cuffs.

9. The garment of claim 3 said elastic resistance bands extending across said body portion and down said sleeves, and each of said sleeves having a compression anchoring cuff, and an end of said band being secured to said anchoring cuff.

10. The garment of claim 3 wherein said at least one elastic resistance band extends across said body portion of said shirt portion and down said sleeves, a plurality of compression cuffs on each of said sleeves, and said elastic resistance bands being secured to said compression cuffs.

* * * * *